US006982734B2

(12) United States Patent
Pan et al.

(10) Patent No.: US 6,982,734 B2
(45) Date of Patent: Jan. 3, 2006

(54) PRINTING ON ELECTRICALLY WRITABLE MEDIA AND ELECTRICALLY WRITABLE DISPLAYS

(75) Inventors: Alfred I-Tsung Pan, Sunnyvale, CA (US); Steven Rosenberg, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 133 days.

(21) Appl. No.: 10/679,922

(22) Filed: Oct. 6, 2003

(65) Prior Publication Data

US 2005/0073571 A1 Apr. 7, 2005

(51) Int. Cl.
*B41J 2/00* (2006.01)

(52) U.S. Cl. ..... 347/120; 347/123; 347/125

(58) Field of Classification Search ..... 347/120, 347/123–125

See application file for complete search history.

(56) References Cited

U.S. PATENT DOCUMENTS 4,584,592 A 4/1986 Tuan et al.
4,588,997 A 5/1986 Tuan et al.
5,351,995 A 10/1994 Booker
5,389,945 A 2/1995 Sheridon
5,866,284 A 2/1999 Vincent
6,057,907 A * 5/2000 Satoh et al. ..... 355/53
6,081,285 A * 6/2000 Wen et al. ..... 347/111
6,456,272 B1 9/2002 Howard et al.
6,550,997 B1 4/2003 King et al.
6,556,470 B1 4/2003 Vincent et al.
6,707,479 B1 * 3/2004 Pan et al. ..... 347/112
2002/0057250 A1 5/2002 Michaelis
2002/0131151 A1 9/2002 Engler et al.
2003/0117456 A1 6/2003 Silverbrook et al.

OTHER PUBLICATIONS

Babak Kavoosi, "Printed Micro Systems on Paper: Active Imaging and Visual Information on Paper and Paper-Based Products," Helsinki University of Technology Laboratory of Media Technology (Dec. 12, 2001).

* cited by examiner

*Primary Examiner*—Huan Tran

(57) ABSTRACT

Apparatus and methods of printing on electrically writable media and electrically writable displays are described. In one aspect, a printer for printing on an electrically writable medium includes a source of an invisible charge species, and a charge species projector. The charge species projector is operable to project charge species from the source onto the medium to electrically reorient switchable display elements in the medium. In another aspect, a portable storage device that includes a memory and an electrically writable medium is received. Data is written to the memory of the portable data storage device. The electrically writable medium of the portable data storage device is printed on by electrically reorienting switchable display elements in the medium. In another aspect, an electrically writable display includes an electrically writable medium that is incorporated into a continuous web having an outward-facing side and an inward-facing side. The outward-facing side of the continuous web presents a display surface of the electrically writable medium. The electrically writable display further includes a scroll system that is operable to scroll the display surface of the electrically writable medium through a display area.

35 Claims, 6 Drawing Sheets

PRINTING ON ELECTRICALLY WRITABLE MEDIA AND ELECTRICALLY WRITABLE DISPLAYS

TECHNICAL FIELD

This invention relates to apparatus and methods of printing on an electrically writable medium and to electrically writable displays.

BACKGROUND

Many companies are developing electronic paper, which is a display system that retains images with little or no power. Images typically are generated on an electronic paper medium by selectively applying an electric field to switchable display elements (e.g., dichroic spheres) in localized regions of the medium. In a typical implementation, an electrically conductive backplane electrode is placed behind the electronic paper medium and a second electrically conductive front plane electrode is placed in front of the electronic paper medium. Applying an electric field of one polarity to the medium switches the display elements to one orientation (e.g., black-side-up), and reversing the polarity of the applied electric field switches the display elements to a second orientation (e.g., white-side-up). A two-dimensional electrode grid with individually addressable cells may be used to provide an electric field in selected areas of the electronic paper medium. Alternatively, a single electrode or multiple electrodes in a head may be scanned across the electronic paper as the paper is advanced by a roller system. In some systems, the position of the electronic paper is fixed and one or more electrodes are scanned across the electronic paper. The electronic paper medium remains in the switched (or "printed") state after the electric field is removed, until a new electric field is applied to change the orientation of the display elements.

One known electrode array printer for printing on rewritable electronic paper includes an array of independently addressable electrodes, each capable of applying a localized field to the rewritable media to rotate dichroic spheres within a given pixel area of a rewritable medium. In another known electrically writable media printing technique, a laser scanner is used to erase a uniform high-voltage charge that was deposited on the surface of a photoconductor drum or belt. The voltage swing between charged and discharged areas of the photoconductor is conventionally on the order of about 500–600 volts. When the rewritable medium is brought in contact with the charge-written photoconductor through a biased back electrode roller, electric fields that are generated between the photoconductor and back electrode cause color rotation of the dichroic spheres to develop a desired print image.

SUMMARY

In one aspect, the invention features a printer for printing on an electrically writable medium. The printer includes a source of an invisible charge species, and a charge species projector. The charge species projector is operable to project charge species from the source onto the medium to electrically reorient switchable display elements in the medium.

In another aspect, the invention features a method of printing on an electrically writable medium, in which invisible charge species from a source are projected onto the medium to electrically reorient switchable display elements in the medium.

In another aspect of the invention, a printer for printing on an electrically writable medium includes a source of a charge species, and a charge species projector. The charge species projector includes a mask defining an image and configured to project charge species from the source through the mask and onto the medium to electrically reorient switchable display elements in the medium.

In another aspect, the invention features a method of printing on an electrically writable medium in which charge species from a source are projected through a mask and onto the medium to electrically reorient switchable display elements in the medium.

In one aspect of the invention, a system includes a memory interface and a print head. The memory interface is operable to write data to a memory of a portable data storage device including an electrically writable medium. The print head is operable to print on the electrically writable medium of the portable data storage device by electrically reorienting switchable display elements in the medium.

In another aspect of the invention, a portable storage device that includes a memory and an electrically writable medium is received. Data is written to the memory of the portable data storage device. The electrically writable medium of the portable data storage device is printed on by electrically reorienting switchable display elements in the medium.

In another aspect, the invention features an electrically writable display that includes an electrically writable medium containing electrically responsive switchable display elements. The electrically writable medium is incorporated into a continuous web having an outward-facing side and an inward-facing side. The outward-facing side of the continuous web presents a display surface of the electrically writable medium. The electrically writable display further includes a scroll system that is operable to scroll the display surface of the electrically writable medium through a display area.

The invention also features display method in accordance with which an electrically writable medium containing electrically responsive switchable display elements is provided. The electrically writable medium is incorporated into a continuous web having an outward-facing side and an inward-facing side. The outward-facing side of the continuous web presents a display surface of the electrically writable medium. The display surface of the electrically writable medium is scrolled through a display area.

In another aspect, the invention features an electrically writable display that includes an electrically writable medium and an external print head. The electrically writable medium has a front side and a back side and contains electrically responsive switchable display elements. The front side of the electrically writable medium presents a display surface that includes an optically transparent, electrically conductive layer. The external print head is disposed adjacent to the back side of the electrically writable medium and is operable to apply an electric field sufficient to electrically reorient switchable display elements contained in the electrically writable medium. The applied electric field extends from the back side of the electrically writable medium, through the electrically writable medium, to the front side display surface.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Multiple embodiments of printers for printing on electrically writable media and multiple embodiments of electrically writable displays are described in detail below. In general, the printer embodiments may print on and the electrically writable displays may include any type of medium that has localized regions with display elements that are electrically switchable to produce visible content (e.g., an image containing one or more of pictures, graphics, and text). Exemplary switchable display elements include bi-stable, dual-color microcapsules, dichroic spheres, and optically anisotropic colorant particles.

Figure 1:
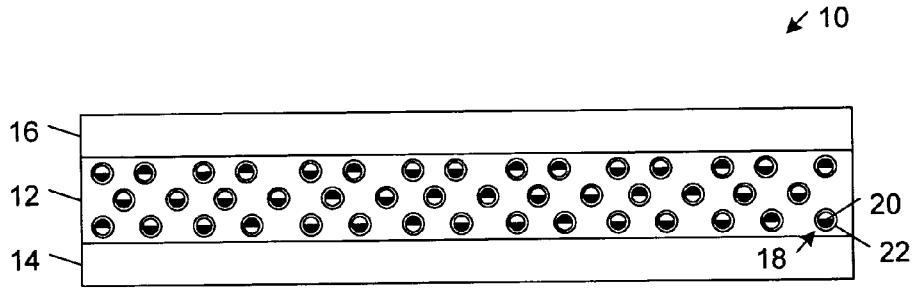
FIG. 1 is diagrammatic cross-sectional side view of an implementation of an electrically writable medium.

FIG. 1 shows an embodiment of an electrically writable medium 10 that includes at least one colorant layer 12 that is disposed between a pair of protective layers 14, 16. The colorant layer 12 is formed from a polymer binder and a plurality of switchable display elements that are implemented in the form of bi-stable, dual-color microcapsules 18. Each microcapsule 18 includes a solid bi-colored sphere 20 housed in a microencapsulating shell 22. Each microcapsule sphere 20 is coated with a lubricating fluid. Each sphere 20 is colored white on one hemisphere and colored black on the opposing hemisphere. The black colorant may be vapor-deposited, for example, on a solid white sphere that may be made of, for example, a pigmented glass, a polymer, or a ceramic. The vapor deposit contains charge species that give each of the spheres 20 an electric dipole for field alignment. The resulting charge on each bi-colored sphere allows the bi-colored spheres 20 to be oriented in accordance with an applied electric field so that each sphere 20 presents either the white hemisphere face or the black hemisphere face at the top surface of the electrically writable medium. The microcapsules 18 may be supported in a fixed polymer coating layer, while allowing each microcapsule sphere 20 to rotate within the microencapsulating shell 22. The electrically writable medium 10 preferably contains a sufficient density of microcapsules 18 so that the electrically writable medium 10 appears completely white or completely black when all of the microcapsules 18 are oriented in the same direction.

In general, protective layer 14 may be formed of any flexible, fibrous or non-fibrous sheet material. In some embodiments, the protective layer 14 of electrically writable medium 10 has the look and feel of paper, but has far greater durability than most, commonly-used cellulose fiber papers. Such media are known in the art, and commonly consist of polymeric impregnated papers or polymeric fibers woven or assembled into films that have a paper appearance. Examples of such papers include Tyvek® (available from E. I. du Pont de Nemours and Company of Wilmington, Del., U.S.A.) and a series of Master-Flex™ papers (available from Appleton Papers Inc. of Appleton, Wis., U.S.A.).

Top protective layer 16 is optional and may be coated over the colorant layer 12 to increase the durability of electrically writable medium 10. Protective layer 16 may be formed of a transparent polymer, such as PMMA (polymethylmethacrylate), or a blend of polymers. In some embodiments, the polymer binder and microcapsule shells 20 have matching refractive indices to minimize light scattering within the colorant layer 12, improving image contrast. The gloss of the electrically writable medium 10 may be controlled by the characteristics of the colorant layer 12 or the optional protective layer 16, or both. In some embodiments, the refractive indices of protective layer 16 and colorant layer 12 may be mismatched to enhance the "white paper" mode by inducing additional light scattering to enhance whiteness.

Figure 2:
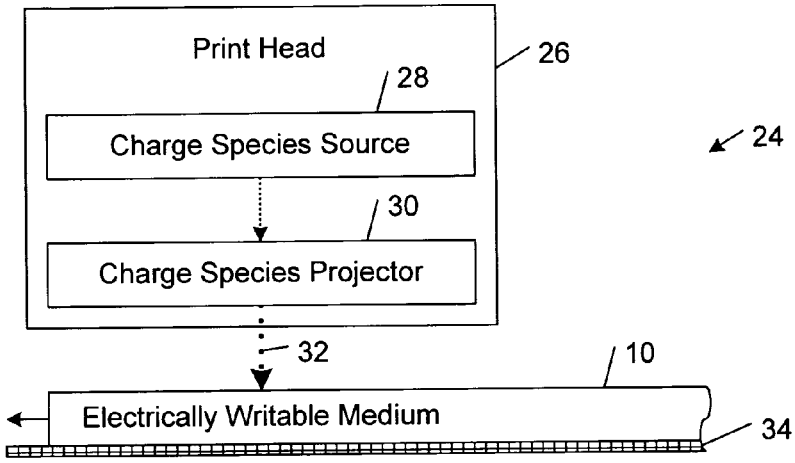
FIG. 2 is a block diagram of an embodiment of a printer that includes a print head for printing on an electrically writable medium.

FIG. 2 shows an embodiment of a printer 24 that includes a print head 26 that is operable to print on electrically writable medium 10. Printer 24 may be implemented in the form of a conventional desktop printer (e.g., a DESKJET® printer available from Hewlett-Packard Company of Palo Alto, Calif., U.S.A.). Print head 26 includes a source 28 of a charge species and a charge species projector 30 that projects charge species 32 from the source onto the medium 10 to electrically reorient switchable display elements in the medium 10 to produce visible content. As used herein, the term "charge species" broadly refers to any type of charged particle (e.g., electrons or ions) or charged molecule. In some implementations, charge species of only a single charge polarity (e.g., positive charge polarity) are deposited onto the electrically writable medium 10 during printing.

Electrically writable medium 10 is conveyed through printer 24 along a feed path that includes a section adjacent to print head 26 where charge species are deposited onto the exposed surface of electrically writable medium 10. The deposited charge species produce localized electric fields that are greater than the threshold electric field needed to reorient the switchable display elements of electrically writable medium 10 in the vicinity of the deposited charge species. In the illustrated embodiment, the feed path includes an electrically conductive support member 34 that forms an electrically conductive backplane (or back electrode), which contributes to the establishment of an electric field from the deposited charge species through electrically writable medium 10. In some implementations, support member 34 is connected to a fixed electric potential (e.g., ground). In other implementations, the electric potential of support member 34 is allowed to float with respect to the charge of the deposited charge species.

Figure 3A:
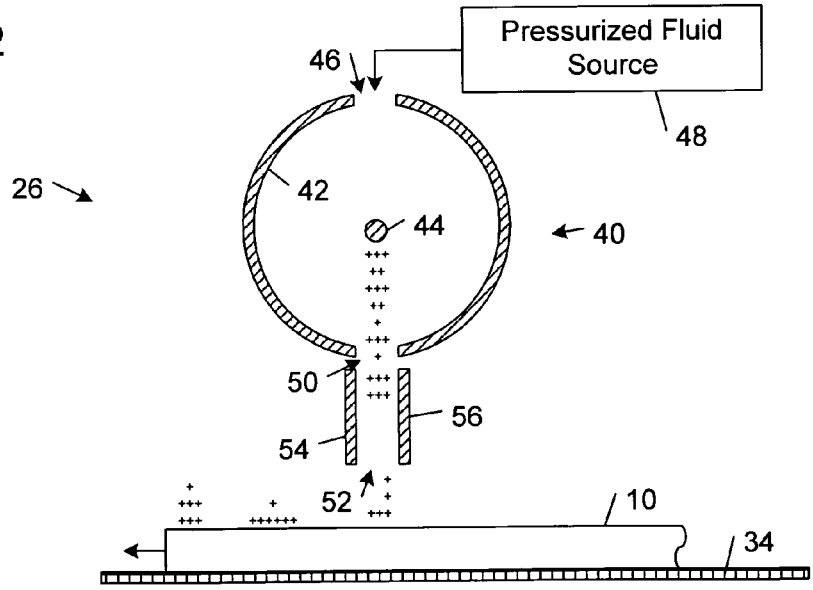
FIG. 3A is a diagrammatic view of an implementations of the print head in the printer embodiment of FIG. 2 that includes a source of an invisible charge species.

FIG. 3A shows an implementation of print head 26 that includes a housing 40 that encloses an ion generation region including an electrically conductive chamber 42 and an electrode 44. The electrode 44 is connected to a source of electric potential. The electrically conductive chamber 42 is connected to a reference potential source (e.g., ground). Upon application of a high potential to the electrode 44, a corona discharge is created around the electrode 44 that creates within chamber 42 ions of a particular polarity (e.g., positively charged ions) that are attracted to the walls of chamber 42.

An inlet port 46 delivers pressurized fluid (e.g., air) into the chamber 42 from a source 48. The pressurized fluid transports ions out of chamber 42, through an outlet port 50, and into an ion modulation region 52, which is defined by a pair of modulation electrodes 54, 56. In some implementations, chamber 42 is cylindrical and includes multiple sets of outlet ports and associated modulation electrodes that are arranged along a line parallel to the cylindrical axis and are configured to selectively deposit ions in respective localized areas along a linear path on the surface of electrically writable medium 10. In these implementations, printer 24 is configured to convey electrically writable medium 10 past print head 26 along a feed path that is substantially perpendicular to the cylindrical axis of chamber 42.

One of the modulation electrodes 54, 56 is connected to a reference voltage (e.g., ground), and the other modulation electrode is switched selectively between a switching voltage (e.g., on the order of 10–20 volts direct current) in a non-deposition mode and the reference voltage in an ion-deposition mode. In the non-deposition mode, an electric modulation field is established between the modulation electrodes 54, 56 in a direction transverse to the direction of ion flow out of outlet port 50. In one implementation, the electric modulation field drives ions toward the electrode that is connected to the reference potential, where they are neutralized into uncharged (i.e., neutral) particles or molecules. In this mode of operation, no ions are deposited on electrically writable medium 10. In the ion deposition mode, the ions entrained by the transport fluid freely pass without modulation through the ion modulation region and impinge on a localized region of the surface of electrically writable medium 10 that is directly in the path of the ions. In this way, a pattern of charge species may be formed on electrically writable medium 10 by selectively turning on and off the modulation field between modulation electrodes 54, 56.

In some implementations electrically conductive support member 34 is connected to a potential source that has a sign opposite to that of the potential applied to the electrode 44. In these implementations, the potential applied to support member 34 generates an electric field between electrode 44 and support member 34 that accelerates ions from chamber 42 toward electrically writable medium 10.

The ions that are deposited on electrically writable medium 10 are not themselves visible to the naked eye. A visual image, however, is created in electrically writable medium 10 by the electric fields created by the regions of deposited ions, as explained above in connection with FIG. 2. After the visual image is formed, the deposited charge species may be actively neutralized (e.g., by contact with a grounded electrode) or they may be passively neutralized by interaction with free charges in the printer environment.

Figure 3B:
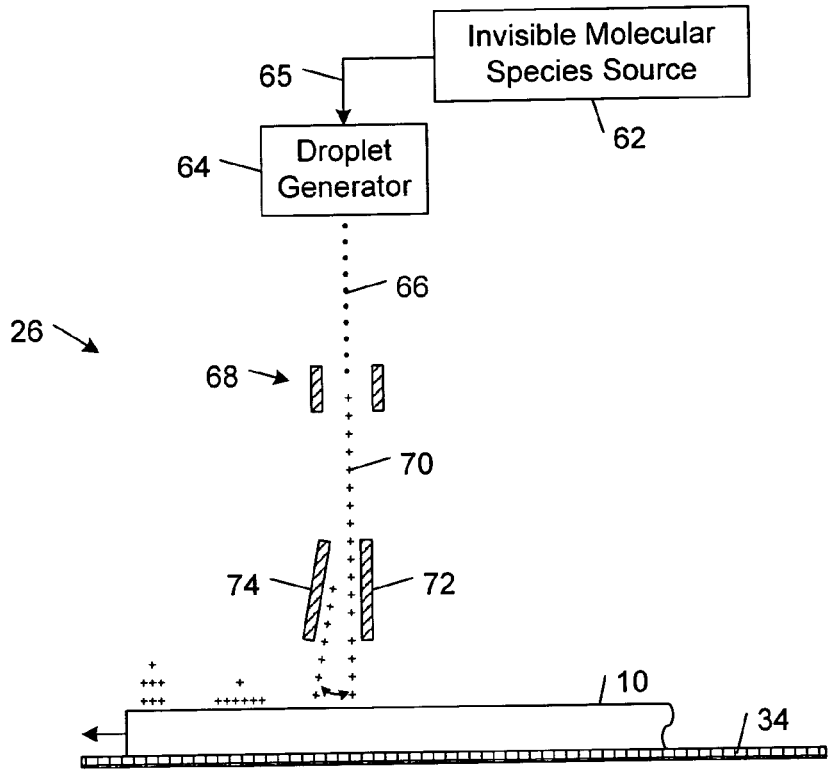
FIG. 3B is a diagrammatic view of an implementation of the printer embodiment of FIG. 2 that includes a source of an invisible molecular species.

FIG. 3B shows an implementation of print head 26 that includes a source 62 of a liquid containing an invisible molecular species and a droplet generator 64. As used herein, the term "invisible molecular species" refers to any type of molecular species that is not visible to the naked eye when deposited on a substrate medium. The type of molecular species supplied from source 62 typically is characterized by properties, such as viscosity, wettability and the ability to retain a charge, that are similar to the properties of typical ink jet inks. In one exemplary implementation, the invisible molecular species includes a conventional invisible ink.

In operation, source 62 supplies a liquid stream 65 containing invisible molecular species under pressure to the droplet generator 64. The droplet generator 64 creates ultrasonic pressure waves in the liquid stream 65 that breaks the liquid stream 65 into separate droplets 66. The droplets 66 pass through a charging region of a charge electrode 68, where each droplet 66 is charged electrostatically. The amount of charge carried by each charged droplet 70 depends upon the voltage applied to the charge electrode 68. The charged droplets 70 then pass through an electrostatic field set up between two high voltage deflector plates 72, 74. The flight direction (or trajectory) a charged droplet 70 passing between deflector plates 72, 74 is changed by an amount that depends on the applied electric field strength and the amount of charge carried by the droplet. In some implementations, droplets that are not required for printing either are not charged by charge electrode 68 or are deflected to a gutter location where they are collected for recycling.

The charged molecular species that are deposited on electrically writable medium 10 are not themselves visible to the naked eye. A visual image, however, is created in electrically writable medium 10 by the electric fields created by the regions of deposited charged molecular species, as explained above in connection with FIG. 2. After the visual image is formed, the deposited molecular species may be actively neutralized (e.g., by contact with a grounded electrode) or they may be passively neutralized by interaction with free charges in the printer environment.

Figure 3C:
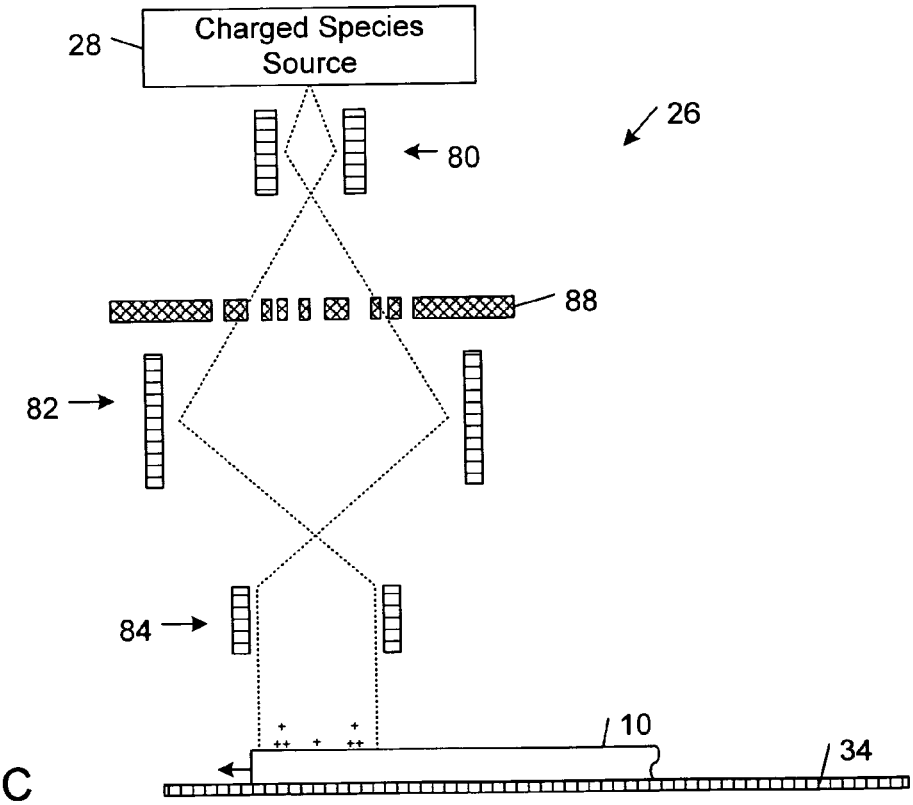
FIG. 3C is a diagrammatic view of an implementation of the print head in the printer embodiment of FIG. 2 that includes a series of lenses guiding charged species from a source through a mask defining at least a portion of an image to be printed on the electrically writable medium.

FIG. 3C shows an embodiment of print head 26 that includes a series of lenses 80, 82, 84 guiding charged species from source 28 through a mask 88 defining at least a portion of an image to be printed on electrically writable medium 10. The source 28 may supply any type of invisible charge species, including charged particles, such as ions, and charged molecules. Lens 80 is an electrostatic lens (e.g., an Einzel lens), which focuses the charge species onto mask 88. Mask 88 may be any form of stencil-type mask that selectively transmits charge species in areas corresponding to the regions of electrically writable medium 10 that are to be charged to form a selected image and that blocks charge species corresponds to other areas of electrically writable medium 10. Lens 82 may be an electric or magnetic lens that projects the aperture of lens 80 onto the aperture of lens 84. Lens 84 is an electrostatic lens (e.g., an Einzel lens) that focuses the charge species passing through mask 88 onto electrically writable medium 10. In this way, charge species may be deposited onto localized areas of electrically writable medium 10, where they produce electric fields that reorient switchable display elements in the medium 10 to form an image as described above in connection with FIG. 2.

Figure 4:
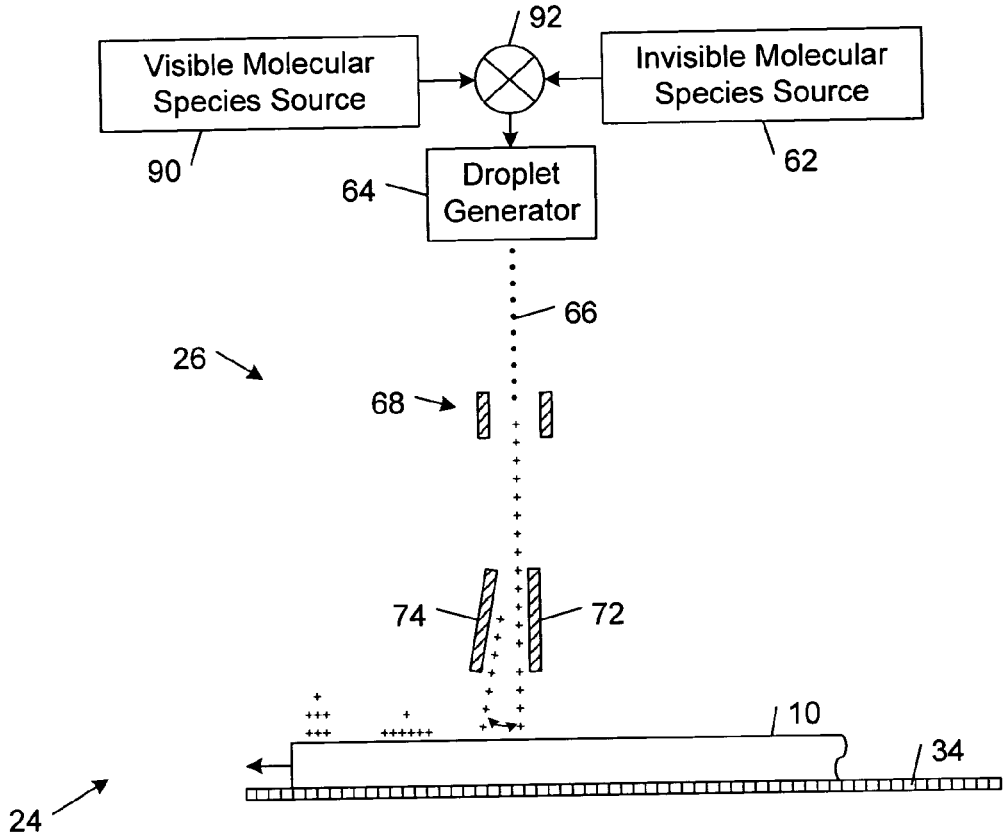
FIG. 4 is a diagrammatic view of an implementation of the printer embodiment of FIG. 2 that includes a source of an invisible molecular species and a source of a visible molecular species.

FIG. 4 shows a dual printing mode implementation of printer 24 that includes the invisible molecular species source 62 and the implementation of print head 26 shown in FIG. 3B, but this implementation of printer 24 further includes a source 90 of a visible molecular species and a manifold 92. The visible molecular species may be, for example, any form of visible ink jet printer ink. This implementation of printer 24 is operable to print on both electrically writable media and conventional paper-like substrates. In particular, when printing on electrically writable media, manifold 92 is switched to supply the invisible molecular species from source 62 to droplet generator 64. When printing on non-electrically-writable media (e.g., paper), on the other hand, manifold 92 is switched to supply visible molecular species from source 90 to droplet generator 64. The deposition of invisible and visible molecular species onto electrically writable medium 10 is controlled in the same way described above in connection with the implementation of FIG. 3B.

Figure 5:
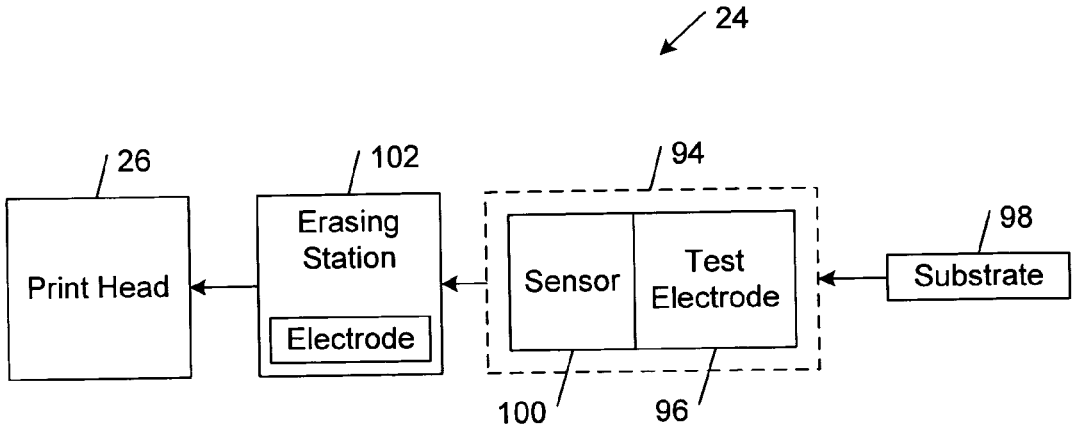
FIG. 5 is a block diagram of an implementation of the printer embodiment of FIG. 2 that includes a substrate type detector, an erasing station, and a print head.

Referring to FIG. 5, some dual printing mode implementations of printer 24 include, upstream of the print head 26, a substrate type detector 94 that is operable to detect whether an electrically writable medium or a conventional print medium has been loaded for printing. For example, substrate type detector 94 may include a test electrode 96 that applies a bias to mark (e.g., produce a discernable color change in a localized region) a substrate 98 that is being fed through the printer 24. A sensor 100 (e.g., a photodetector), which is positioned downstream of the test electrode 96, detects whether the applied bias produced a test mark on the substrate 98 and produces a signal indicative of the type of substrate that is loaded into the printer for printing. With respect to the exemplary dual mode printer embodiment of FIG. 4, if the test mark is detected, the manifold 92 is switched to supply invisible molecular species from source 62 to droplet generator 64. If the test mark is not detected, manifold 92 is switched to supply visible molecular species from source 90 to droplet generator 64.

As shown in FIG. 5, some embodiments may include, upstream of print head 26, an erasing station 102 that includes, for example, a charged-electrode that is biased to orient all of the switchable display elements of an electrically writable medium in the same direction (e.g., white sides facing up) before visible content is printed on the electrically writable medium.

In some dual printing mode implementations, printer 24 is configured to accept user input specifying the type of media that has been loaded for printing.

Figure 6A:
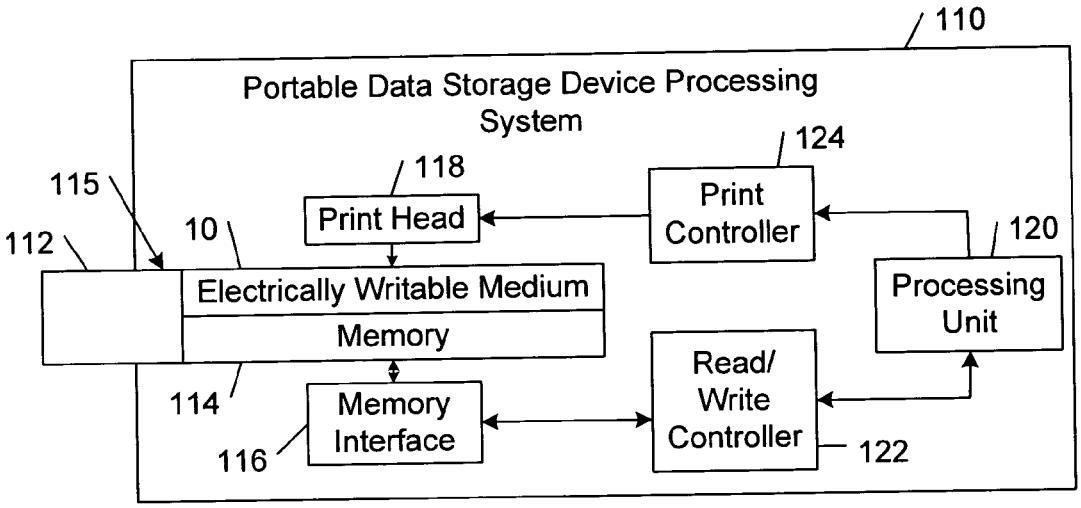
FIG. 6A is a block diagram of an embodiment of a system for processing a portable data storage device that includes a memory interface for writing data to a memory of the portable data storage device and a print head for printing on an electrically writable medium carried on the portable data storage device.

FIG. 6A shows a system 110 for processing a portable data storage device 112, which includes a memory 114 and an electrically writable medium 10. Portable data storage device 112 may be implemented in the form of any self-contained portable memory device form factor, including a card (e.g., a Smart Card or magnetic swipe card), a circular disk (e.g., a DVD or CD disk), or a rectangular disk (e.g., memory card, a 3.5 inch floppy disk, or a ZIP Drive disk). Memory 114 may include any type of non-volatile memory, including, for example, semiconductor memory devices, such as EPROM, EEPROM, and flash memory devices; magnetic memory devices, such as removable hard disks; magneto-optical disks; and optical disks, such as DVD-ROM, DVD-RAM, CD-ROM, and CD-RAM. Among the application environments for which processing system 110 may be tailored are the following, automatic teller machines, automatic checkout machines (e.g., for retail purchases and library book borrowing), and automated medical history update machines.

Processing system 110 includes a holder 115 (e.g., a slot or a tray) that is configured to receive portable data storage device 112 and hold portable storage device 112 while data is being written to memory 114 and while content is being printed on electrically writable medium 10.

Processing system 110 includes a memory interface 116 that is constructed and arranged to write data to the memory 114 of portable data storage device 112. The particular implementation of memory interface 116 depends on the particular implementation of memory 114. For example, in some application environments (e.g., CD or DVD based memory environments), the memory interface 116 includes an electromechanical data head configured to write data to memory 114. In other application environments (e.g., smart card based memory environments), the memory interface 116 includes a connector that delivers electronic instructions to a mated connector of memory 114. In some implementations, memory interface 116 is operable to read data from memory 114 of portable data storage device 112.

Processing system 110 also includes a print head 118 that is operable to print on the electrically writable medium 10 that is carried by portable data storage device 112. The particular implementation of print head 118 depends on the particular implementation of electrically writable medium 10. In general, print head 118 may be any form of print head that is capable of printing on electrically writable medium 10 by electrically reorienting switchable display elements in the medium. For example, in some implementations, print head 118 may be implemented in accordance with any one of the print head embodiments described above. In some embodiments, print head 118 also is operable to selectively erase regions of electrically writable medium 10.

Processing system 110 also includes a processing unit 120, which may include one or more processors, each of which may be in the form of any one of various commercially available processors. Processing unit 120 interfaces with memory interface 116 through a read/write controller 122 and interfaces with print head 118 through a print controller 124.

Figure 6B:
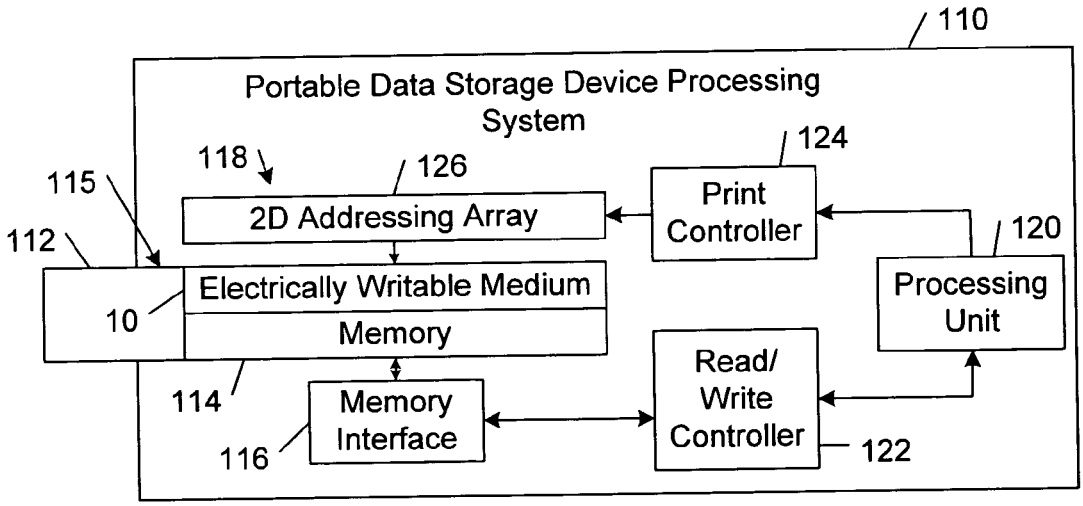
FIG. 6B is a block diagram of an embodiment of the processing system of FIG. 6A that includes a print head implemented in the form of a two-dimensional addressing array for printing on the electrically writable medium.

As shown in FIG. 6B, in one implementation, print head 118 includes a two-dimensional addressing array 126 that includes multiple independently addressable electrodes for simultaneously printing on localized areas of the electrically writable medium 10 by selective application of electric fields to the medium that are sufficient to reorient switchable display elements in the medium.

Figure 7:
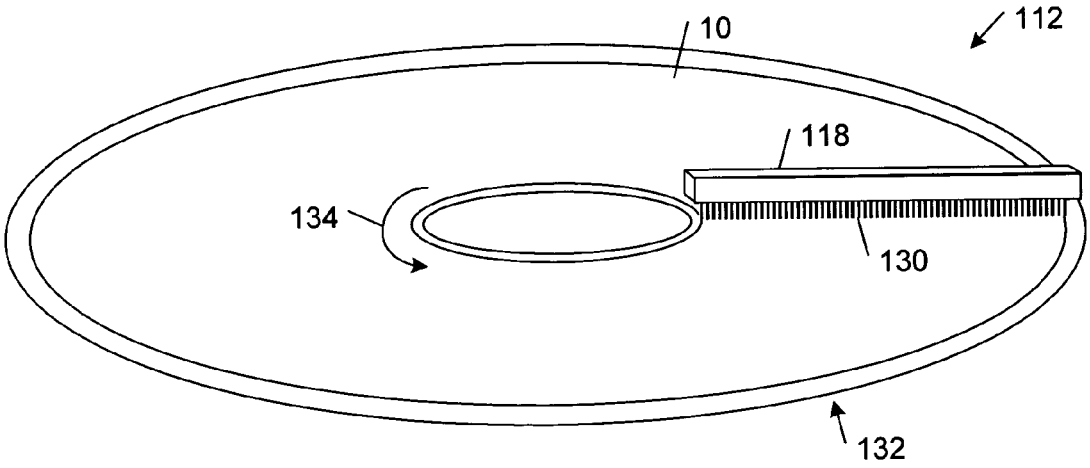
FIG. 7 is a diagrammatic view of an embodiment of a print head printing on an electrically writable medium carried by a portable data storage disk.

FIG. 7 shows an exemplary embodiment of a print head 118 that includes a linear array of electrodes 130 that are operable to simultaneously print on multiple localized areas along a linear path across the surface of an electrically writable medium 10, which is carried on a disk-shaped portable data storage device 112. Portable data storage device 112 may include an optical storage medium 132 (e.g., a CD or DVD based storage medium) on the side of portable data storage device 112 that is opposite the side carrying electrically writable medium 10. In one implementation, portable data storage device 112 spins within holder 115 of processing system 110 in a direction indicated by arrow 134. While device 112 spins, print head 118 may print on electrically writable medium 10. In another implementation, print head 118 is scanned across the surface of electrically writable medium 10 during printing.

Figure 8:
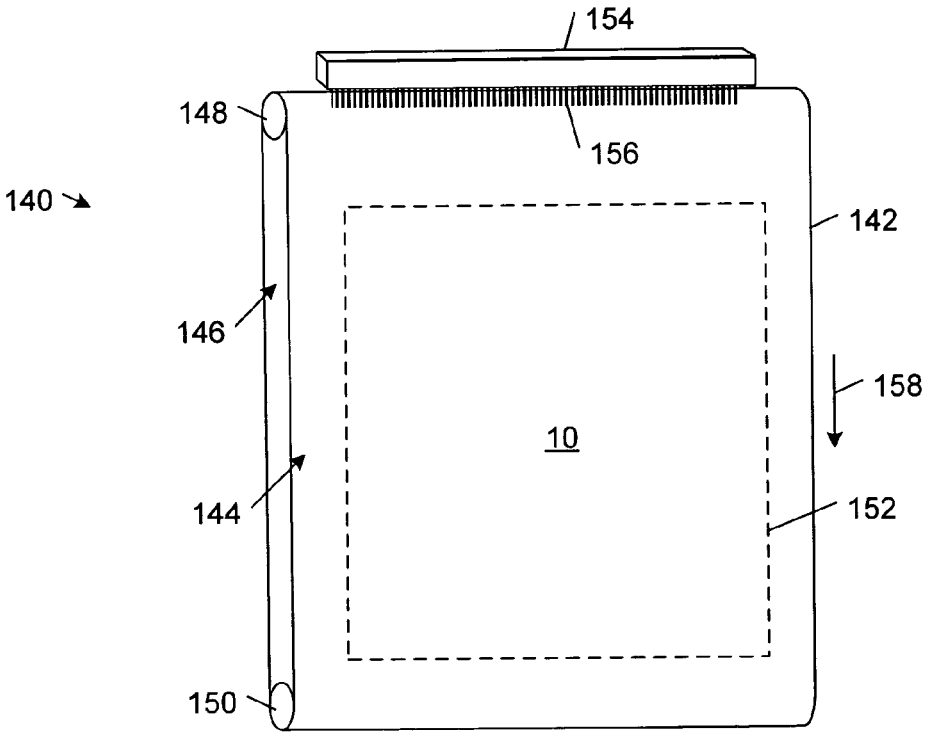
FIG. 8 is a diagrammatic perspective view of an embodiment of an electrically writable display.

FIG. 8 shows an embodiment of an electrically writable display 140 that includes an electrically writable medium 10 containing electrically-responsive switchable display elements. The electrically writable medium 10 is incorporated into a continuous web 142 that has an outward-facing side 144 and an inward-facing side 146. The outward-facing side 144 of the continuous web 142 presents a viewing or display surface of the electrically writable medium 10 (i.e., the surface of electrically writable medium 10 displaying printed content). The continuous web 142 is mounted on a scroll system that includes a pair of rolls 148, 150 that scroll the display surface of the electrically writable medium 10 through a display area 152 (shown by the superimposed dashed rectangle in FIG. 8). The display area 152 may correspond, for example, to a window in a housing containing electrically writable display 140.

Electrically writable display 140 further includes an external print head 154 that is operable to print on the electrically writable medium 10. Print head 154 is located adjacent to the outward-facing side 144 of the continuous web 142. In some embodiments, print head 154 is located adjacent to the inward-facing side 146 of the continuous web 142. In the illustrated embodiment, the print head 154 is fixed in position relative to the scroll system. The print head 154 includes a linear array of electrodes 156 oriented in a direction substantially perpendicular to a direction 158 in which the continuous web 142 is scrolled by the scroll system.

In general, print head 154 may be any form of print head that is capable of printing on electrically writable medium 10 by electrically reorienting switchable display elements in the medium. For example, in some implementations, print head 154 may be implemented in accordance with any one of the print head embodiments described above. In some embodiments, print head 154 also is operable to selectively erase regions of electrically writable medium 10.

Figure 9:
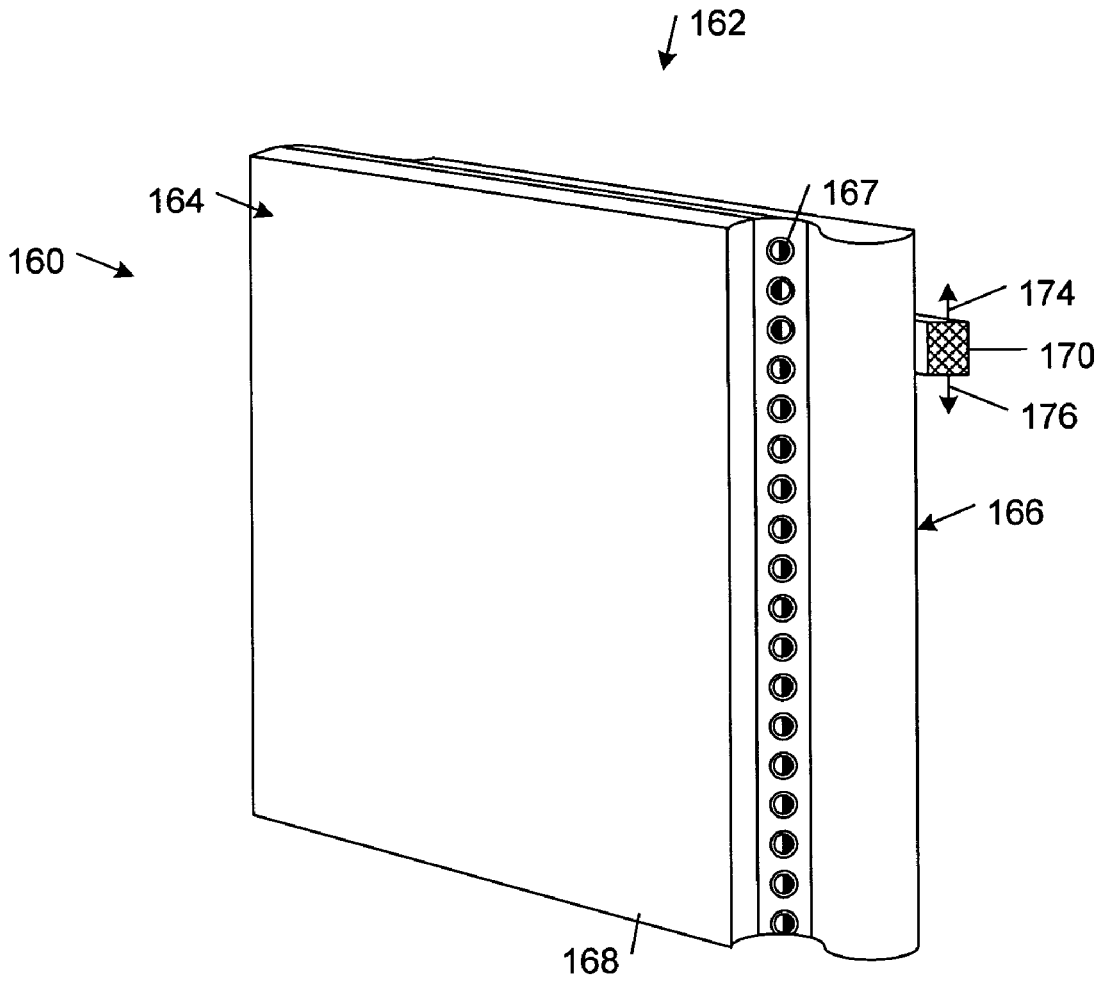
FIG. 9 is a diagrammatic perspective view of a portion of an electrically writable display that includes an external print head and an electrically writable medium with a front side presenting a display surface including an optically transparent, electrically conductive layer.

FIG. 9 shows an embodiment of an electrically writable display 160 that includes an electrically writable medium 162, which has a front side 164 and a back side 166 and contains electrically responsive switchable display elements 167. The front side 164 presents a viewing or display surface that includes an optically transparent, electrically conductive layer 168. Transparent, electrically conductive layer 168 may be formed of any type of material (e.g., indium-tin-oxide) that is electrically conductive and substantially transparent to light in the visible wavelength range. In the illustrated embodiment, the display elements 167 correspond to the microcapsules 18, which are incorporated into the colorant layer 12 described above in connection with the embodiment of FIG. 1. Protective layer 14 is disposed on the backside 166 of electrically writable display 160.

Electrically writable display 160 also includes an external print head 170 that is disposed adjacent to the back side 166 of the electrically writable medium 162 and is operable to apply an electric field sufficient to electrically reorient switchable display elements 167 contained in the electrically writable medium 162. The print head 170 includes a linear array of electrodes that are oriented in a direction substantially perpendicular to directions 174, 176 in which the print head 170 may be scanned across the backside 166 of electrically writable medium 10.

The electric fields that are applied by the electrodes of print head 170 extend from the back side 166 of the electrically writable medium 162, through the electrically writable medium 162, to the front side display surface 168. In general, print head 170 may be any form of print head that is capable of printing on electrically writable medium 10 by electrically reorienting switchable display elements in the medium. For example, in some implementations, print head 170 may be implemented in accordance with any one of the print head embodiments described above. In some embodiments, print head 170 also is operable to selectively erase regions of electrically writable medium 10.

Among the application environments into which electrically writable display 160 may be incorporated are the following, roadside billboard displays, flight arrival and departure displays in airport terminals, and other displays providing information content on-demand, such as information-rich content for museum displays.

Other embodiments are within the scope of the claims.

For example, although the above embodiments are described in connection with one exemplary type of electrically writable medium, these embodiments readily may be used with other types of electrically writable media, including electrically writable media that incorporate optically anisotropic particles having one or more colors in addition to or replacing one or more of the black and white colors, and electrically writable media in which protective layer 14 is electrically conductive and forms an electrically conductive backplane. In some printer embodiments that are designed for use with electrically writable media that have electrically-conductive backplanes, the external surface of support member 34 may be electrically-insulating.

In addition, the above embodiments are described in connection with exemplary print head designs. Other embodiments, however, may be used with different print head designs.

Although systems and methods have been described herein in the context of a particular computing environment, these systems and methods are not limited to any particular hardware or software configuration, but rather they may be implemented in any computing or processing environment, including in digital electronic circuitry or in computer hardware, firmware or software.

What is claimed is:

1. A printer for printing on an electrically writable medium, comprising:

a source of an invisible charge species; and a charge species projector operable to project charge species from the source onto the medium to electrically reorient switchable display elements in the medium.

2. The printer of claim 1, wherein the charge species source comprises a corona discharge source.

3. The printer of claim 2, wherein the charge species source further comprises a source of a transport fluid for entraining charge species generated by the corona discharge source.

4. The printer of claim 1, wherein the charge species source comprises a source of an invisible molecular species.

5. The printer of claim 1, further comprising a source of a visible charge species projectable by the charge species projector onto a non-electrically writable medium.

6. The printer of claim 5, further comprising a media type detector operable to produce a signal indicative of the type of medium loaded into the printer.

7. The printer of claim 6, wherein the charge species projector projects one of the visible and invisible types of charge species based on the signal produced by the media type detector.

8. The printer of claim 1, wherein the charge species projector comprises at least one electrically chargeable deflector plate.

9. The printer of claim 1, wherein the charge species projector comprises a mask defining an image to be projected onto the medium.

10. A method of printing on an electrically writable medium, comprising projecting invisible charge species from a source onto the medium to electrically reorient switchable display elements in the medium.

11. A printer for printing on an electrically writable medium, comprising:

a source of a charge species; and a charge species projector comprising a mask defining an image and configured to project charge species from the source through the mask and onto the medium to electrically reorient switchable display elements in the medium.

12. A method of printing on an electrically writable medium, comprising projecting charge species from a source through a mask and onto the medium to electrically reorient switchable display elements in the medium.

13. A system, comprising:

a memory interface operable to write data to a memory of a portable data storage device that is removable from the system and carries an electrically writable medium that is integrated with the memory into the portable data storage device; and a print head operable to print on the electrically writable medium that is carried by the portable data storage device by electrically reorienting switchable display elements in the medium.

14. A system, comprising:

a memory interface operable to write data to a memory of a portable data storage device including an electrically writable medium;

a print head operable to print on the electrically writable medium of the portable data storage device by electrically reorienting switchable display elements in the medium; and a holder for supporting the portable data device while data is being written and while the electrically writable medium is being printed on.

15. A system, comprising:

a memory interface operable to write data to a memory of a portable data storage device including an electrically writable medium, wherein the memory interface is operable to read data stored on the portable data device; and a print head operable to print on the electrically writable medium of the portable data storage device by electrically reorienting switchable display elements in the medium.

16. A system, comprising:

a memory interface operable to write data to a memory of a portable data storage device including an electrically writable medium; and a print head operable to print on the electrically writable medium of the portable data storage device by electrically reorienting switchable display elements in the medium, wherein the print head is operable to selectively erase regions of the electrically writable medium.

17. A system, comprising:

a memory interface operable to write data to a memory of a portable data storage device including an electrically writable medium, wherein the memory interface is operable to write data to at least one of an optical storage medium, a magnetic storage medium, and a programmable memory storage medium; and a print head operable to print on the electrically writable medium of the portable data storage device by electrically reorienting switchable display elements in the medium.

18. A system, comprising:

a memory interface operable to write data to a memory of a portable data storage device including an electrically writable medium; and a print head operable to print on the electrically writable medium of the portable data storage device by electrically reorienting switchable display elements in the medium, wherein the print head is operable to project charge species onto the electrically writable medium to electrically reorient switchable display elements in the electrically writable medium.

19. The system of claim 13, wherein the print head is operable to simultaneously print on multiple localized areas of the electrically writable medium.

20. The system of claim 19, wherein the print head includes a two-dimensional array of electrodes for simultaneously printing on localized areas of the electrically writable medium.

21. A method, comprising:

receiving a portable storage device including a memory and carrying an electrically writable medium that is integrated with the memory into the portable storage device;

writing data to the memory of the portable data storage device; and printing on the electrically writable medium that is carried by the portable data storage device by electrically reorienting switchable display elements in the medium.

22. An electrically writable display, comprising:

an electrically writable medium containing electrically responsive switchable display elements and being incorporated into a continuous closed-loop web having an outward-facing side and an inward-facing side, the outward-facing side of the continuous web presenting a display surface of the electrically writable medium; and a scroll system operable to scroll the display surface of the electrically writable medium through a display area.

23. The display of claim 22, further comprising an external print head operable to print on the electrically writable medium by electrically reorienting switchable display elements contained in the medium.

24. The display of claim 23, wherein the print head is fixed in position relative to the scroll system.

25. The display of claim 24, wherein the print head comprises a linear array of electrodes oriented in a direction substantially perpendicular to a direction in which the continuous web is scrolled by the scroll system.

26. The display of claim 23, wherein the print head is located adjacent to the outward-facing side of the continuous web.

27. An electrically writable display, comprising:

an electrically writable medium containing electrically responsive switchable display elements and being incorporated into a continuous web having an outward-facing side and an inward-facing side, the outward-facing side of the continuous web presenting a display surface of the electrically writable medium;

a scroll system operable to scroll the display surface of the electrically writable medium through a display area; and an external print head operable to print on the electrically writable medium by electrically reorienting switchable display elements contained in the medium, wherein the print head is operable to selectively erase region of the electrically writable medium.

28. An electrically writable display, comprising:

an electrically writable medium containing electrically responsive switchable display elements and being incorporated into a continuous web having an outward-facing side and an inward-facing side, the outward-facing side of the continuous web presenting a display surface of the electrically writable medium;

a scroll system operable to scroll the display surface of the electrically writable medium through a display area; and an external print head operable to print on the electrically writable medium by electrically reorienting switchable display elements contained in the medium, wherein the print head is operable to project charge species onto the electrically writable medium to electrically reorient switchable display elements in the electrically writable medium.

29. An electrically writable display, comprising:

an electrically writable medium containing electrically responsive switchable display elements and being incorporated into a continuous web having an outward-facing side and an inward-facing side, the outward-facing side of the continuous web presenting a display surface of the electrically writable medium;

a scroll system operable to scroll the display surface of the electrically writable medium through a display area, wherein the inward-facing side of the continuous web has an exposed electrically conductive surface and the scroll system comprises at least one electrically conductive roller contacting the exposed electrically conductive surface of the inward-facing side of the continuous web; and an external print head operable to print on the electrically writable medium by electrically reorienting switchable display elements contained in the medium.

30. A display method, comprising:

providing an electrically writable medium containing electrically responsive switchable display elements and being incorporated into a continuous closed-loop web having an outward-facing side and an inward-facing side, the outward-facing side of the continuous web presenting a display surface of the electrically writable medium; and scrolling the display surface of the electrically writable medium through a display area.

31. An electrically writable display, comprising:

an electrically writable medium having a front side and a back side and containing electrically responsive switchable display elements, the front side presenting a display surface including an optically transparent, electrically conductive layer; and an external print head disposed adjacent to the back side of the electrically writable medium and operable to apply an electric field sufficient to electrically reorient switchable display elements contained in the electrically writable medium, the applied electric field extending from the back side of the electrically writable medium, through the electrically writable medium, to the front side display surface.

32. The display of claim 31, wherein the print head comprises a linear array of electrodes.

33. The display of claim 32, further comprising a scanning system operable to scan the print head across the back side of the electrically writable medium.

34. The display of claim 31, wherein the print head is operable to selectively erase region of the electrically writable medium.

35. The display of claim 31, wherein the print head is operable to project charge species onto the back side of the electrically writable medium to electrically reorient switchable display elements in the electrically writable medium.

* * * * *